US006753516B1

(12) United States Patent
Butler et al.

(10) Patent No.: US 6,753,516 B1
(45) Date of Patent: Jun. 22, 2004

(54) METHOD AND APPARATUS FOR CONTROLLING AN ELECTRIC FIELD INTENSITY WITHIN A WAVEGUIDE

(75) Inventors: Hardy Butler, Durham, NC (US); Ben Adu, Frederick, MD (US); J. Michael Drozd, Raleigh, NC (US); William T. Joines, Durham, NC (US); Esther Drozd, Lexington, NC (US)

(73) Assignee: Industrial Microwave Systems, L.L.C., Morrisville, NC (US)

( * ) Notice: Subject to any disclaimer, the term of this patent is extended or adjusted under 35 U.S.C. 154(b) by 0 days.

(21) Appl. No.: 09/730,804

(22) Filed: Dec. 7, 2000

Related U.S. Application Data

(60) Provisional application No. 60/169,229, filed on Dec. 7, 1999.

(51) Int. Cl.[7] ..... H05B 6/70

(52) U.S. Cl. ..... 219/745; 219/693; 219/695

(58) Field of Search ..... 219/745, 746, 219/750, 741, 742, 692, 693, 695; 333/17.1, 125; 343/727

(56) References Cited

U.S. PATENT DOCUMENTS

| | | | | |
|---|---|---|---|---|
| 3,474,209 A | | 10/1969 | Parker | |
| 3,555,232 A | | 1/1971 | Bleakley | 219/693 |
| 3,617,953 A | * | 11/1971 | Kingma et al. | 333/17.1 |
| 3,882,505 A | * | 5/1975 | Mailloux | 343/727 |
| 4,401,873 A | * | 8/1983 | Berggren et al. | 219/693 |
| 5,536,921 A | * | 7/1996 | Hedrick et al. | 219/693 |
| 5,663,693 A | * | 9/1997 | Doughty et al. | 333/125 |
| 5,958,275 A | * | 9/1999 | Joines et al. | 219/693 |
| 6,259,077 B1 | * | 7/2001 | Drozd et al. | 219/693 |

FOREIGN PATENT DOCUMENTS

GB 650337 A 2/1951

OTHER PUBLICATIONS

J.T. Bernhard and W.T. Joines, "Electric Field Distributions in TEM Waveguides Versus Frequency," *Journal of Microwave Power and Electromagnetic Energy*, 1995, 109–116, vol. 30, No. 2.

A.L. VanKoughnett and W. Wyalouzil, "A Waveguide TEM Mode Exposure Chamber," *Journal of Microwave Power*, 1972, 381–383, 7 (4).

Kashyap, S.C., and Dunn, J.G., "A Waveguide Applicator for Sheet Materials," IEEE Trans. on Microwave Theory & Techniques, vol. 24, no 2, Feb. 1976, p. 125, IEEE, Inc. New York.

* cited by examiner

*Primary Examiner*—Quang Van

(57) ABSTRACT

A device for heating a material utilizes a rectangular waveguide with an elongated opening for passing a planar material through the rectangular waveguide. A source creates an electric field between a top surface and a bottom surface of the rectangular waveguide. The electric field is controlled to compensate for attenuation of the electric field. The electric field can be controlled by, for example, using a dielectric slab along the top surface of the rectangular waveguide or a tapered dielectric slab along the top surface of the rectangular waveguide. The electric field can also be controlled by, for example, making the waveguide appear electrically wider at one end. The waveguide can be made to appear electrically wider at one end by, for example, inserting one or more tapered fins. The tapered fins can be adjusted or removed to account for the lossiness of the planar material.

20 Claims, 4 Drawing Sheets

METHOD AND APPARATUS FOR CONTROLLING AN ELECTRIC FIELD INTENSITY WITHIN A WAVEGUIDE

This application claims priority under 37 C.F.R. § 1.119 (e) of U.S. Provisional Application No. 60/169,299 filed Dec. 7, 1999, which is incorporated by reference in its entirety.

FIELD OF THE INVENTION

This invention relates to electromagnetic energy, and more particularly, to electromagnetic exposure of planar materials.

BACKGROUND

In microwave heating and drying applications involving waveguide structures, uniform heating is desirable but is only achievable if the ability exists to expose every section of the material (the web) to the same electric field intensity. Lossy materials absorb energy and thus cause attenuation of the electric field intensity in the dimension of propagation in the waveguide. As a result, the traditional technique of inserting the lossy materials longitudinally in the center of the waveguide results in a non-uniform distribution of energy across the width of the lossy material. To correct this, it is necessary to manipulate the electric field distribution in the waveguide such that when a lossy material is placed inside, the effect due to attenuation is balanced by the initial electric field distribution. The net result is an electric field with the same intensity at all points along the material. This leads to the expression of "compensating for the attenuation."

There are several proposed methods for compensating for attenuation. One method is to insert the web into a diagonal slotted waveguide structure as is described and claimed in U.S. Pat. No. 5,958,275, which is incorporated by reference in its entirety. In essence, this method achieves uniformity by physically changing the material's position within the electric field distribution. This is very effective for uniformly exposing thin materials to microwave energy over a wide web. Unfortunately, for thicker dielectric materials within a diagonal slotted waveguide, uniformity is more difficult to achieve, due to the "skewing" of the electric field by the material. Unlike a thin material, the thicker material cannot be inserted into the guide without it having a significant effect on the electric field distribution.

SUMMARY

A device for heating a material comprises a rectangular waveguide with an elongated opening for passing a planar material through the rectangular waveguide. A source creates an electric field between a top surface and a bottom surface of the rectangular waveguide. The electric field is controlled to compensate for attenuation of the electric field. The electric field can be controlled by, for example, using a dielectric slab along the top surface of the rectangular waveguide or a tapered dielectric slab along the top surface of the rectangular waveguide. The electric field can also be controlled by, for example, making the waveguide appear electrically wider at one end. The waveguide can be made to appear electrically wider at one end by, for example, inserting one or more tapered fins. The tapered fins can be adjusted or remove to account for the lossiness of the planar material.

One advantage of the disclosed invention is that it is possible to heat thick, high-dielectric materials. Another advantage is that a tapered dielectric slab greatly simplifies the fabrication process and adds more flexibility to the overall system. Machining a dielectric slab with a specified taper is a relatively easy task. Instead of designing a different waveguide slot angle for each different material, the slot in the waveguide can now be the same for all materials, and different control slabs can be used for materials which need different tapers.

BRIEF DESCRIPTION OF THE DRAWINGS

The foregoing, and other objects, features, and advantages of the invention will be more readily understood upon reading the following detailed description in conjunction with the drawings in which.

DETAILED DESCRIPTION

In the following description, specific details are discussed in order to provide a better understanding of the invention. However, it will be apparent to those skilled in the art that the invention can be practiced in other embodiments that depart from these specific details. In other instances, detailed descriptions of well-known methods and circuits are omitted so as to not obscure the description of the invention with unnecessary detail.

Figure 1A:
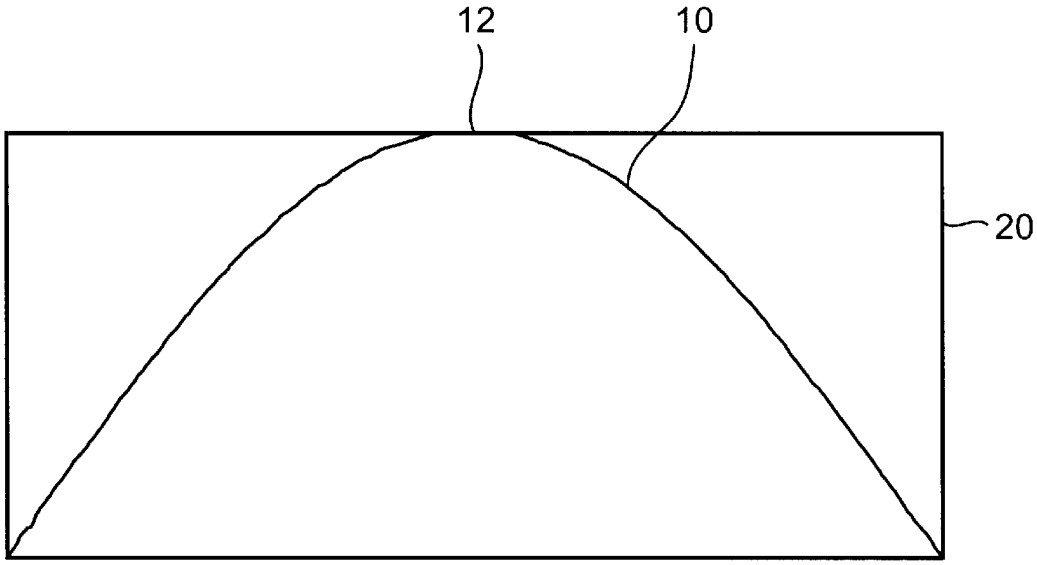
FIG. 1*a* illustrates an electric field distribution in an empty waveguide.

Referring now to the drawings, FIG. 1*a* illustrates an electric field distribution 10 in an empty waveguide 20. If the empty waveguide 20 is operated in $TE_{10}$ mode, the electric field distribution 10 is a half sine wave and the peak field intensity 12 is located directly at the center of the waveguide's long cross-sectional dimension.

Figure 1B:
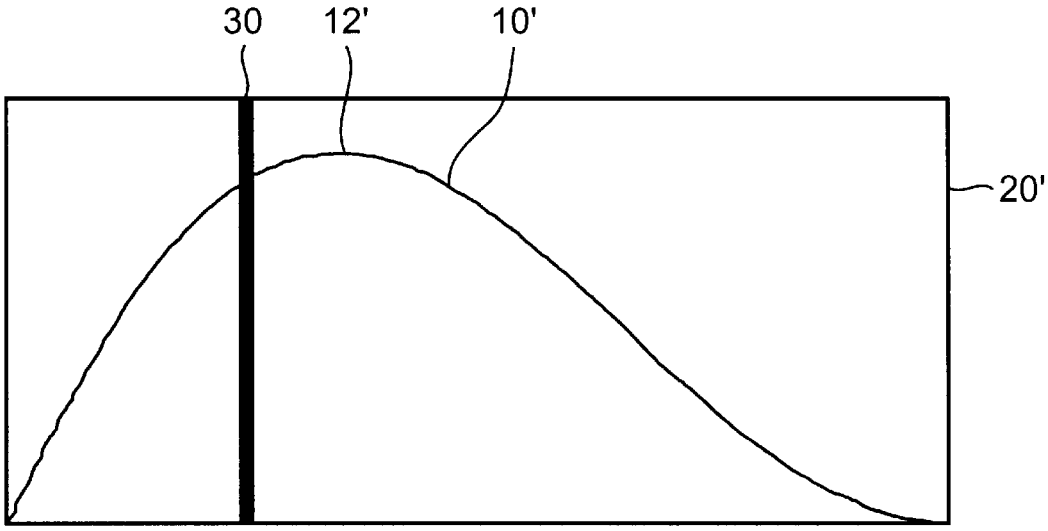
FIG. 1*b* illustrates an electric field distribution in a waveguide with dielectric material inserted.

FIG. 1*b* illustrates an electric field distribution 10' in a waveguide 20' with dielectric material 30 inserted. When a thick, dielectric material 30 is inserted longitudinally into the waveguide 20', the electric field distribution 10' is shifted toward the material 30. The more closely the peak electric field intensity 12' "follows" the inserted material 30, the more difficult it becomes to expose the material to a different field strength by physically moving it to a different location in the waveguide 20'. To counter this problem, it is proposed to strategically insert a slab 40 with known dielectric properties into the waveguide 20' to alter the field 10' such that the field that the material 30 is exposed to can be controlled.

Figure 2A:
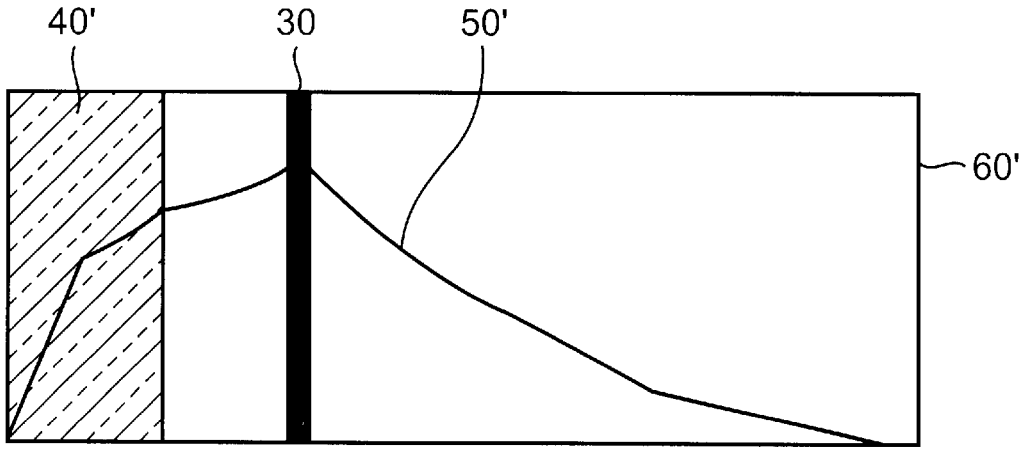
FIG. 2*a* illustrates an electric field distribution in a waveguide with a thicker control slab.
Figure 2B:
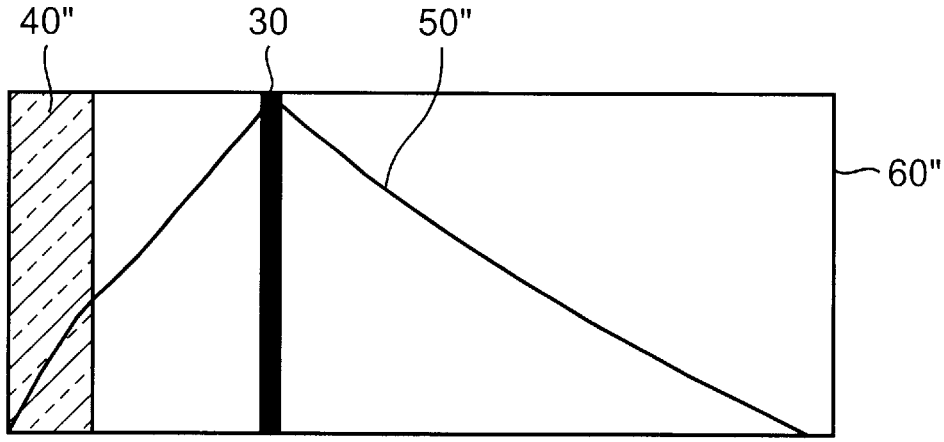
FIG. 2*b* illustrates an electric field distribution in a waveguide with a thinner control slab.

FIG. 2*a* illustrates an electric field distribution 50' in a waveguide 60' with a thicker control slab 40'. FIG. 2*b* illustrates an electric field distribution 50" in a waveguide 60" with a thinner control slab 40". It is important to note that the field experienced by the material is dependent upon the thickness of the inserted control slab 40. By varying the thickness of the slab 40 in the waveguide's propagating dimension (i.e. inserting a tapered slab), the electric field seen by the web can be maintained at a constant intensity by taking into account the attenuation of the waveform as it travels through the material and along the waveguide.

Figure 3:
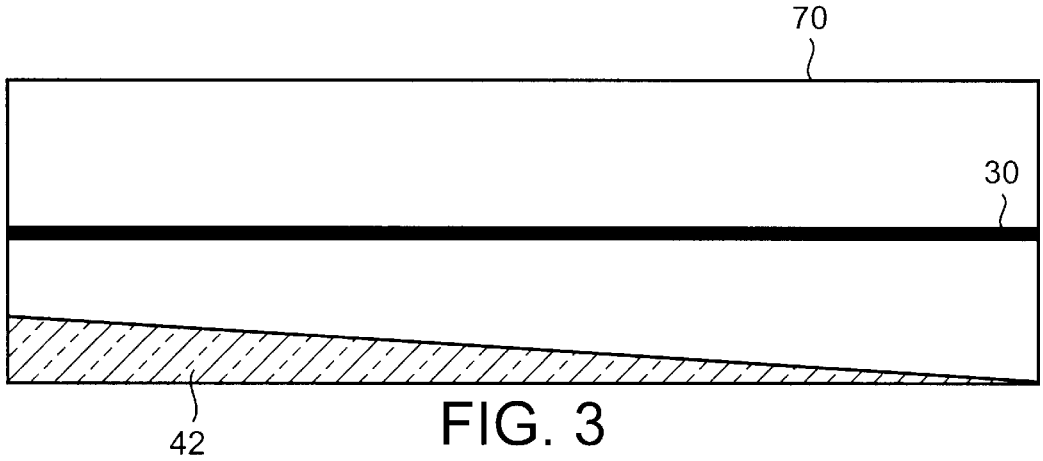
FIG. 3 illustrates a top view of a waveguide with a tapered control slab inserted.
Figure 4:
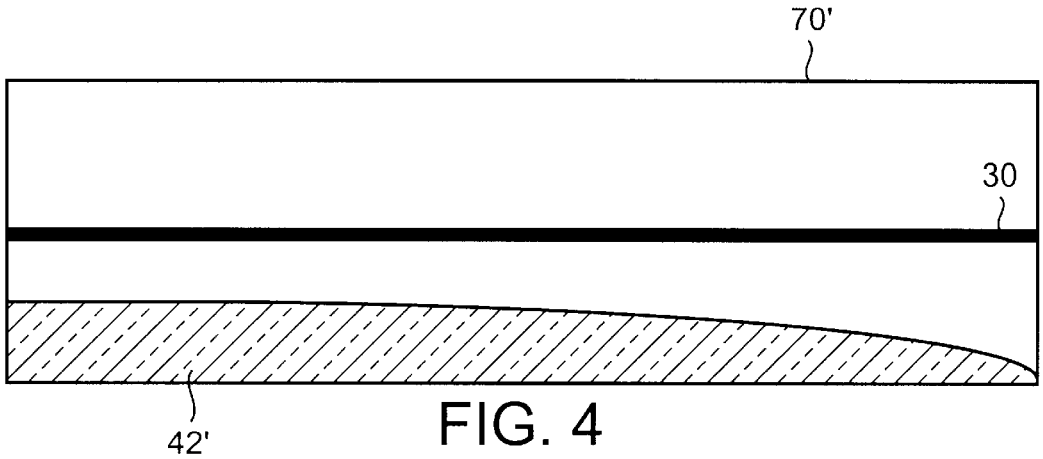
FIG. 4 illustrates a top view of a waveguide with a non-linearly tapered control slab inserted.
Figure 5:
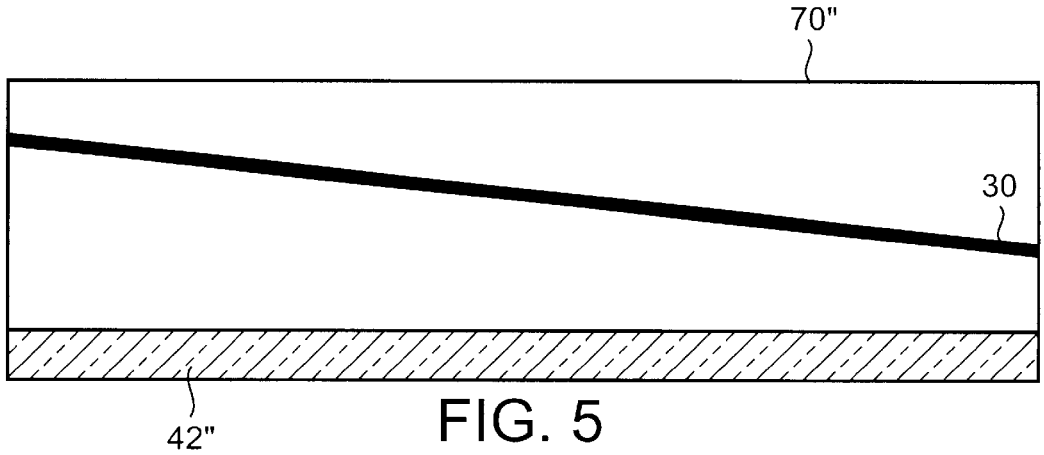
FIG. 5 illustrates a top view of a waveguide with a non-tapered control slab and a slot angle.

FIG. 3 illustrates a top view of a waveguide 70 with a tapered control slab 42 inserted. It is important to note that, although the taper shown in FIG. 3 is linear, the idea can be extended to include any desired taper, such as the one in FIG. 4. Another way to realize this sort of control is to use a constant-width control slab 42" along with the aforementioned waveguide slot angle. This effectively results in the same situation as above, but in this case, the varying proximity of the control slab 42" to the material 30 under test is what determines the field skewing instead of the varying thickness of the control slab. A top view of such a setup is shown in FIG. 5.

Figure 6:
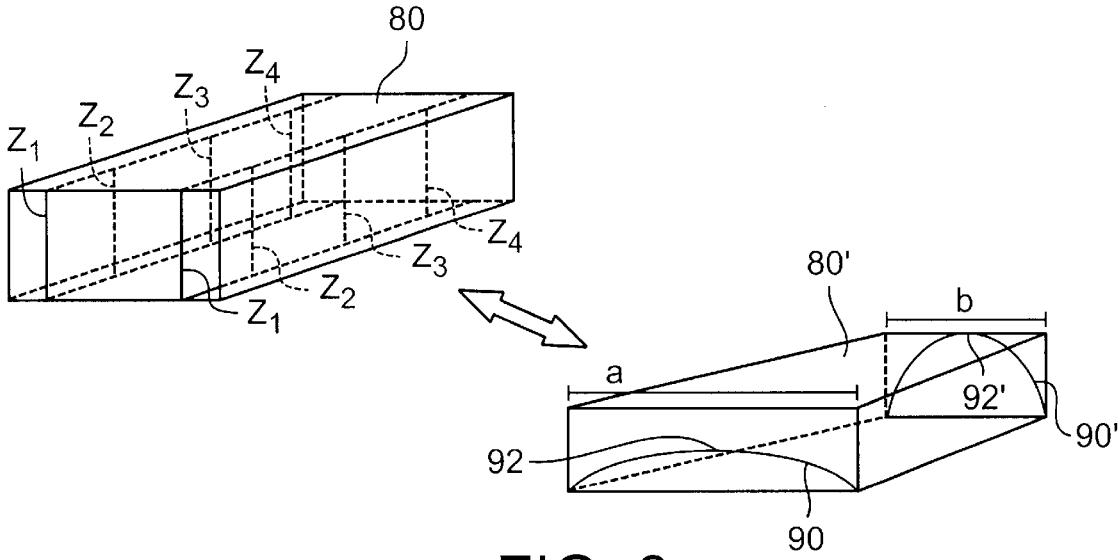
FIG. 6 illustrates a method for making a rectangular waveguide appear to be tapered.

FIG. 6 illustrates a method for making a rectangular waveguide 80 appear to be tapered 80'. In this method, modifications are made to the interior of the waveguide to effectively create tapered impedances ($Z_1$, $Z_2$, $Z_3$, $Z_4$, . . . ) such that the waveguide 80 actually has the response of a tapered waveguide 80' whose long dimension is changing. This changing width changes the peak field intensity 92 seen along the waveguide. Because a is wider than b, the peak field intensity 92 of electric field distribution 90 is less than the peak field intensity of 92' of electric field distribution 90'. Thus, the impedances can be chosen such that the overall structure compensates for attenuation along waveguide 80.

Figure 7:
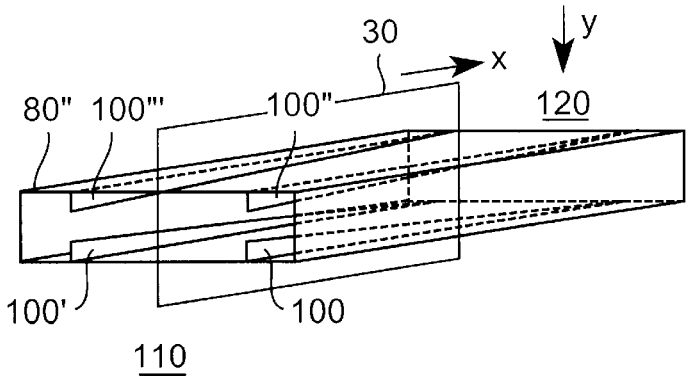
FIG. 7 illustrates waveguide "fins" for making a rectangular waveguide appear to be tapered.

FIG. 7 illustrates waveguide "fins" 100 for making a rectangular waveguide 80" appear to be tapered. The tapered fins 100 create the tapered impedances. If a source is located at end 110, it is possible to account for attenuation of an electromagnetic wave as the electromagnetic wave propagates from end 110 to end 120. It is also possible to pass dielectric material 30 through an elongated slot between fins 100 and 100' and between fins 100" and 100'". If dielectric material 30 is passed through waveguide 80" in direction x, dielectric material 30 is heated more uniformly as it travels along waveguide 80". If dielectric material 30 is passed through waveguide 80" in direction y, dielectric material 30 is heated more uniformly from edge to edge.

While the foregoing description makes reference to particular illustrative embodiments, these examples should not be construed as limitations. Thus, the present invention is not limited to the disclosed embodiments, but is to be accorded the widest scope consistent with the claims below.

What is claimed is:

1. A device for heating a material, the device comprising:

a rectangular waveguide with an elongated opening for passing a planar material through the rectangular waveguide;

a microwave signal generator, the microwave signal generator creating a microwave signal that creates an electric field between a top surface and a bottom surface of the rectangular waveguide; and a dielectric device for controlling the electric field within the waveguide to compensate for attenuation of the electric field as the microwave signal moves away from the microwave signal generator.

2. A device as described in claim 1, the device for controlling the electric field consisting of a dielectric slab along the top surface of the rectangular waveguide.

3. A device as described in claim 1, the device for controlling the electric field comprising a tapered dielectric slab along the top surface of the rectangular waveguide.

4. A device as described in claim 1, wherein the elongated opening is a diagonal opening and the device for controlling the electric field comprises a dielectric slab along the top surface of the rectangular waveguide.

5. A device as described in claim 1, the device for controlling the electric field comprising a tapered dielectric slab, the tapered dielectric slab located between the elongated opening and the top surface.

6. A device as described in claim 5, a non-tapered side of the tapered dielectric slab, not opposite the tapered side of the dielectric slab, oriented parallel with the top surface.

7. A device as described in claim 1, the device for controlling the electric field comprising a pair of tapered dielectric slabs, the pair of tapered dielectric slabs located between the elongated opening and the top surface.

8. A device as described in claim 7, a non-tapered side of each of the pair of tapered dielectric slabs, not opposite the tapered side of the dielectric slab, oriented parallel with the top surface.

9. A device as described in claim 1, the device for controlling the electric field comprising:

a first pair of tapered dielectric slabs, the first pair of tapered dielectric slabs located between the elongated opening and the top surface; and a second pair of tapered dielectric slabs, the second pair of tapered dielectric slabs located between the elongated opening and the bottom surface.

10. A device as described in claim 9, wherein a non-tapered side of each of the first pair of tapered dielectric slabs, not opposite the tapered side of the dielectric slab, oriented parallel with the top surface and a non-tapered side of each of the second pair of tapered dielectric slabs, not opposite the tapered side of the dielectric slab, oriented parallel with the bottom surface.

11. A method for heating a material, the method comprising the steps of:

generating a microwave signal that creates an electric field between a top surface and a bottom surface of a rectangular waveguide with an elongated opening;

passing a material through the elongated opening; and controlling the electric field by positioning a dielectric device within the waveguide to compensate for attenuation of the electric field as the microwave signal moves away from the microwave signal generator.

12. A method as described in claim 11, the step of controlling the electric field performed by a dielectric slab along the top surface of the rectangular waveguide.

13. A method as described in claim 11, the step of controlling the electric field performed by a tapered dielectric slab along the top surface of the rectangular waveguide.

14. A method as described in claim 11, wherein the elongated opening is a diagonal opening and the step of controlling the electric field performed by a dielectric slab along the top surface of the rectangular waveguide.

15. A method as described in claim 11, the step of controlling the electric field performed by a tapered dielectric slab, the tapered dielectric slab located between the elongated opening and the top surface.

16. A method as described in claim 15, a non-tapered side of the tapered dielectric slab, not opposite the tapered side of the dielectric slab, oriented parallel with the top surface.

17. A method as described in claim 11, the step of controlling the electric field performed by a pair of tapered dielectric slabs, the pair of tapered dielectric slabs located between the elongated opening and the top surface.

18. A method as described in claim 17, a non-tapered side of each of the pair of tapered dielectric slabs, not opposite the tapered side of the dielectric slab, oriented parallel with the top surface.

19. A method as described in claim 11, the step of controlling the electric field performed by:

a first pair of tapered dielectric slabs, the first pair of tapered dielectric slabs located between the elongated opening and the top surface; and a second pair of tapered dielectric slabs, the second pair of tapered dielectric slabs located between the elongated opening and the bottom surface.

20. A method as described in claim 19, wherein a non-tapered side of each of the first pair of tapered dielectric slabs, not opposite the tapered side of the dielectric slab, oriented parallel with the top surface and a non-tapered side of each of the second pair of tapered dielectric slabs, not opposite the tapered side of the dielectric slab, oriented parallel with the bottom surface.

* * * * *